United States Patent [19]

Jukkola et al.

[11] 4,301,771

[45] Nov. 24, 1981

[54] FLUIDIZED BED HEAT EXCHANGER WITH WATER COOLED AIR DISTRIBUTOR AND DUST HOPPER

[75] Inventors: Walfred W. Jukkola, Westport, Conn.; Albert M. Leon, Mamaroneck, N.Y.; Garritt C. Van Dyk, Jr., Bethel, Conn.; Daniel E. McCoy, Williamsport, Pa.; Barry L. Fisher, Montgomery, Pa.; Timothy L. Saiers, Williamsport, Pa.; Marlin E. Karstetter, Loganton, Pa.

[73] Assignee: Dorr-Oliver Incorporated, Stamford, Conn.

[21] Appl. No.: 165,352

[22] Filed: Jul. 2, 1980

[51] Int. Cl.[3] ..... F22B 1/02

[52] U.S. Cl. ..... 122/4 D; 110/245

[58] Field of Search ..... 122/4 D; 110/245, 263; 34/57 A; 165/104 F, 1; 431/7, 170

[56] References Cited

U.S. PATENT DOCUMENTS

| | | | |
|---|---|---|---|
| 3,387,590 | 6/1968 | Bishop | 122/4 D |
| 3,736,908 | 6/1973 | Ehrlich et al. | 122/4 D |
| 3,833,051 | 9/1974 | Frank | 165/1 |
| 3,983,927 | 10/1976 | Steever et al. | 165/1 |
| 4,183,330 | 1/1980 | Bryers et al. | 122/4 D |
| 4,184,455 | 1/1980 | Talmud et al. | 122/4 D |
| 4,253,425 | 3/1981 | Gamble et al. | 122/4 D |

*Primary Examiner*—Edward G. Favors

*Attorney, Agent, or Firm*—Burtsell J. Kearns; Harold M. Snyder

[57] ABSTRACT

A fluidized bed heat exchanger is provided in which air is passed through a bed of particulate material containing fuel. A steam-water natural circulation system is provided for heat exchange and the housing of the heat exchanger has a water-wall type construction. Vertical in-bed heat exchange tubes are provided and the air distributor is water-cooled. A water-cooled dust hopper is provided in the housing to collect particulates from the combustion gases and separate the combustion zone from a volume within said housing in which convection heat exchange tubes are provided to extract heat from the exiting combustion gases.

10 Claims, 4 Drawing Figures

FLUIDIZED BED HEAT EXCHANGER WITH WATER COOLED AIR DISTRIBUTOR AND DUST HOPPER

Figure 1:
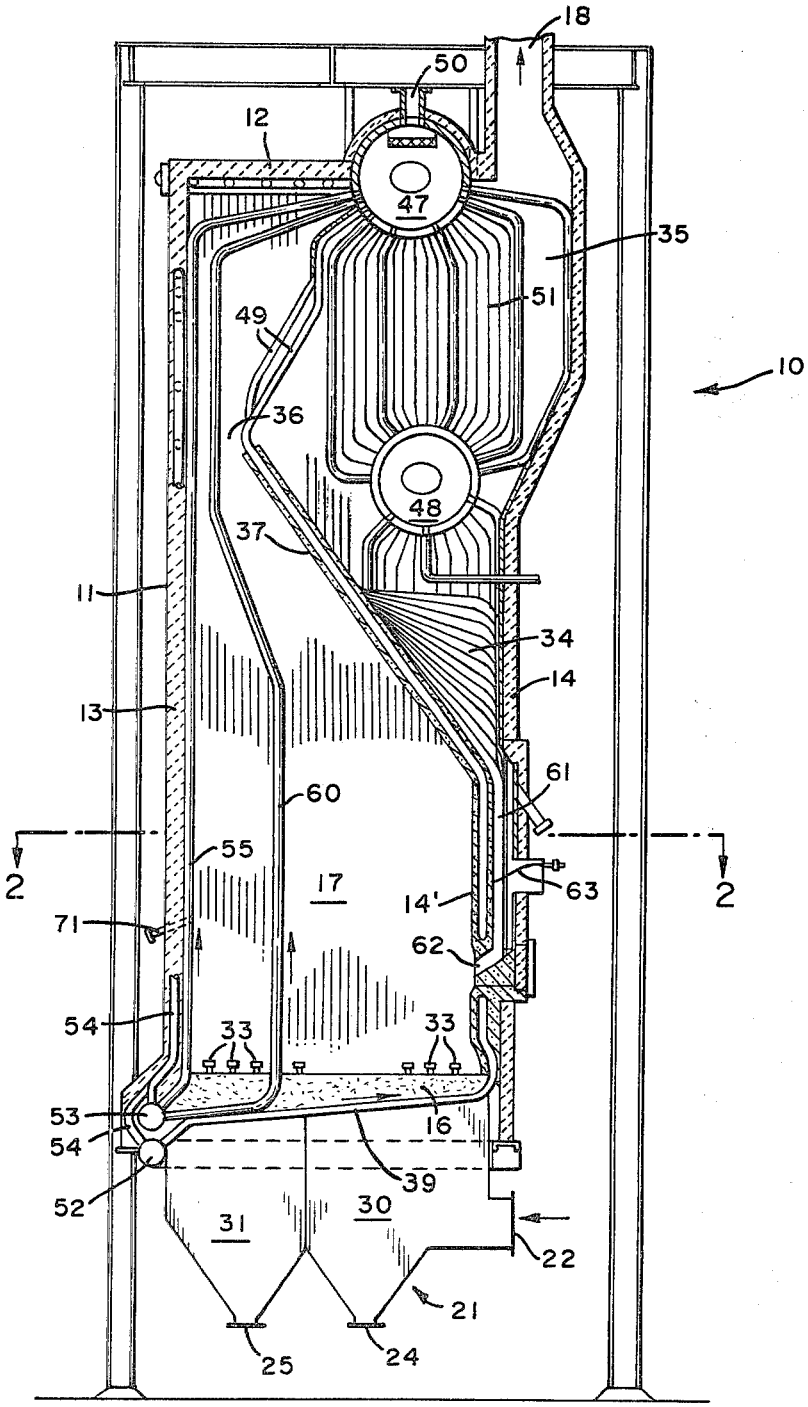

The United States Government, as represented by the Department of Energy, has rights in this invention under Contract No. ET-78-C-01-3269.

SUMMARY OF THE INVENTION

This invention is directed to fluidized bed heat exchangers, and particularly, to heat exchangers having vertically oriented in-bed heat exchange tubes.

Fluidized bed reactors are effective means for generating heat and, in various forms, can carry out the processes of drying, roasting, calcining, heat treatment of solids with gases in the chemical, metallurgical, and other material processing fields, and the generation of hot gases, including steam, for use in driving electric power generation equipment or for process heat, or for other purposes. In reactors generating hot gases, air is passed through a bed of particulate material which includes a mixture of inert material and a fuel material such as coal, wood waste or other combustible materials. Where the combustion of bituminous or anthracite coal or other fuels containing a high sulfur component is undertaken, a material such as lime or limestone which will react with the sulfur released by combustion may be provided in the bed.

Fluidized bed reactors typically comprise a vessel having a substantially horizontal perforate plate; i.e., an air distributor or constriction plate, which supports a bed of particulate solids in the reaction chamber and separates the reaction chamber from a windbox below the plate. Combustion air is introduced into the windbox and passes through the air distributor in sufficient volume to achieve a gas velocity that expands or fluidizes the solids bed, suspending the particulate solids of the bed in the flowing air stream and imparting to the individual particles a continuous random motion. Some important advantages of conducting a combustion reaction in a fluidized bed include the substantially uniform bed temperature, combustion at relatively low temperatures and a high heat transfer rate.

In utilizing solid fuels such as coals or waste products of coal mining (culm or tailings), it will be appreciated that a substantial amount of fuel in the form of fine particles or dust will be elutriated by the upward flow of air in the combustion chamber and may pass from the chamber without being fully combusted. For efficient operation of the unit, this combustible material must be returned to the combustion zone. Commonly, this is done by providing separation capability entirely external of the fluidized bed reactor, but such units (cyclones, for example), add substantially to the capital cost of the fluidized bed installation. Further, in-bed heat exchange tubes of a horizontal orientation are often provided in these units, but such tubes require that the working fluid be pumped to achieve satisfactory circulation of the water and steam therethrough, and the energy required to operate the pumps is a charge against the process. It is also known that horizontal or sloped in-bed tubes in a serpentine configuration are susceptible to erosion particularly at the return bends provided in such arrays.

It is therefore an object of the present invention to provide a fluidized bed heat exchanger which achieves efficient utilization of the fuel fed to the unit.

It is a further object of the present invention that improved life of the in-bed heat exchange tubes be provided.

It is a further object of the present invention to provide a heat exchanger which does not require circulation pumps.

Figure 2:
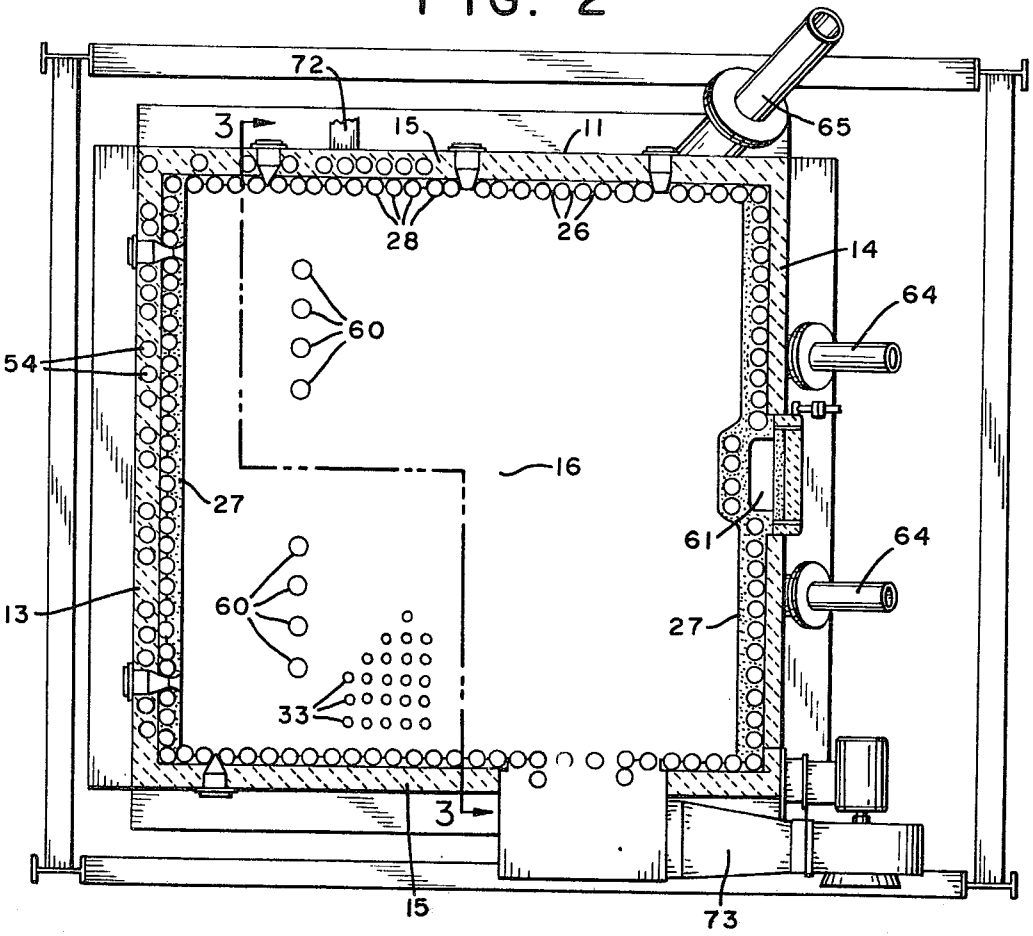
Figure 3:
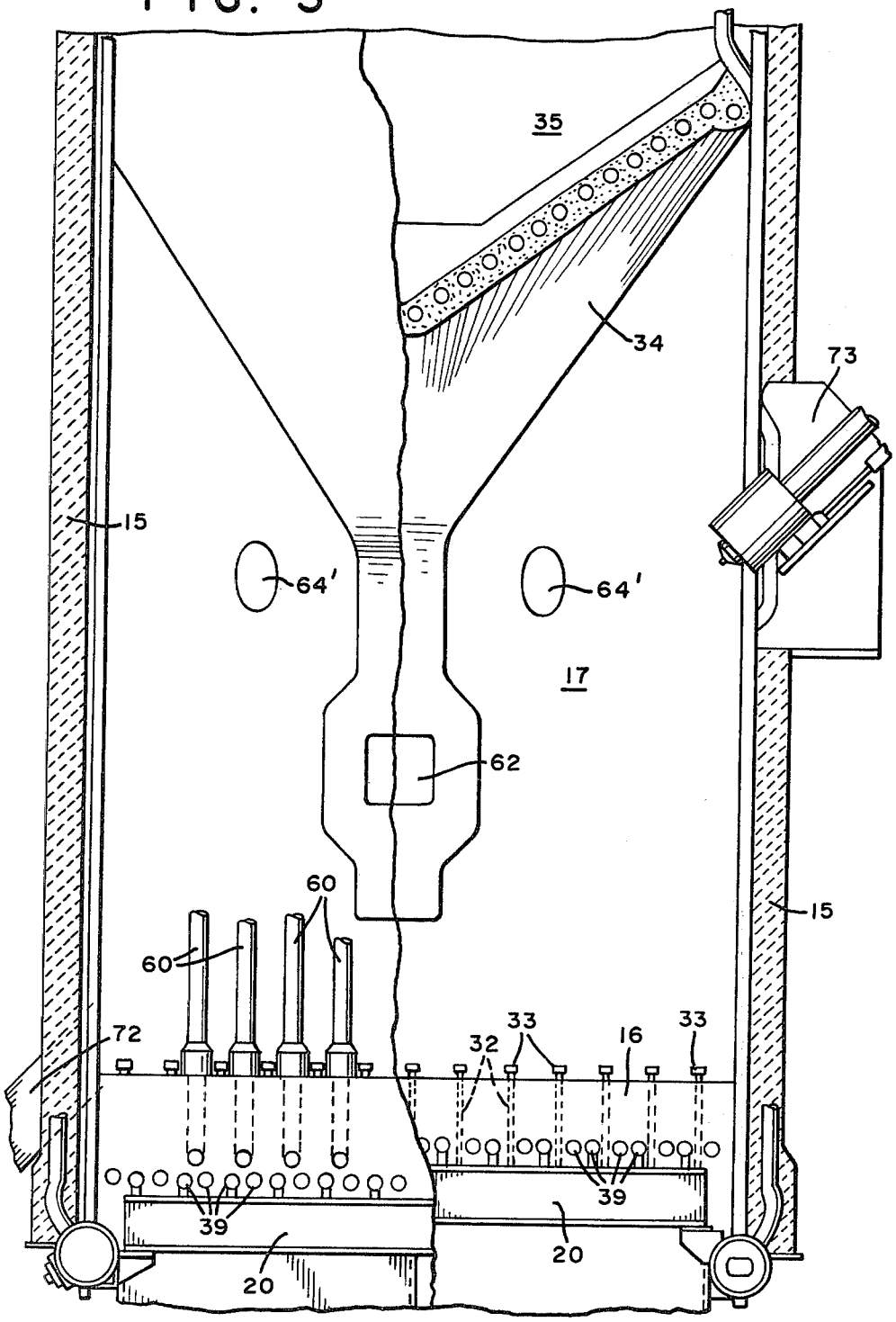
Figure 4:
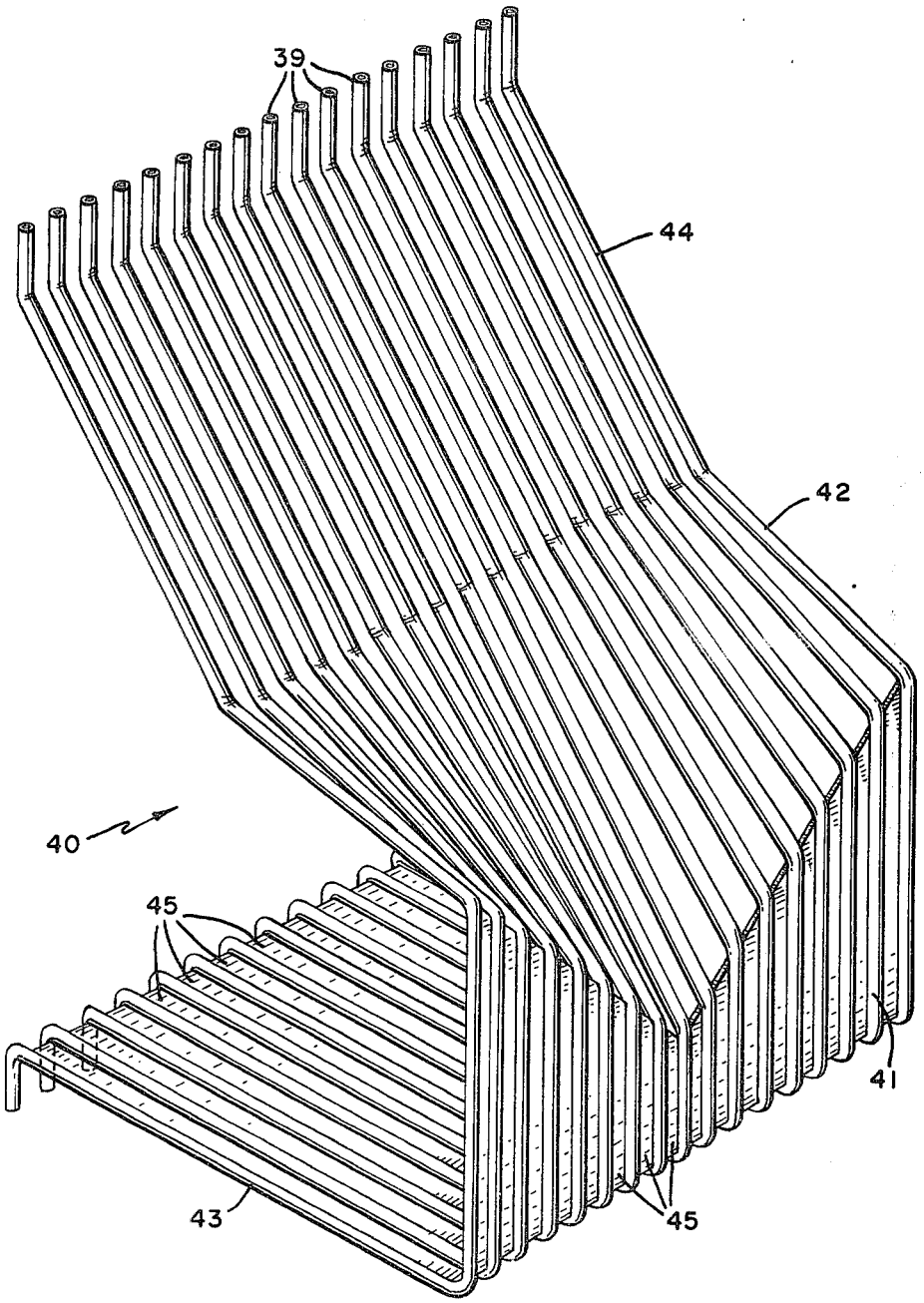

Other objects and advantages will become apparent from the following description taken in conjunction with the accompanying drawings, in which:

FIG. 1 is a schematic cross-sectional view of the fluidized bed heat exchanger of the present invention, FIG. 2 is a schematic cross-sectional view of the fluidized bed heat exchanger of the present invention, taken along the line 2—2 of FIG. 1, FIG. 3 is a schematic cross-sectional view of the fluidized bed heat exchanger of the present invention, taken along the lines 3—3 of FIG. 2 and FIG. 4 is an isometric view of the specially formed integral water-cooled floor and bridgewall assembly of the invention.

The fluidized bed heat exchanger of this invention comprises a housing, a reaction chamber within the housing, means for introducing air into said reaction chamber including a windbox region below said reaction chamber and an air distributor therebetween, an integral water-cooled floor and bridgewall assembly in said housing, a convection heat exchange chamber above said reaction chamber within said housing and separated from said reaction chamber by a slanted baffle, said baffle defining a gas passageway between said reaction chamber and said convection heat exchange chamber and having a hopper portion whereby dust is collected and removed from gases passing through said convection heat exchange chamber, means for establishing a bed of particulate material containing fuel in said reaction chamber, said bed of particulate material being subject to fluidization by air passing into said reaction chamber from said windbox region through said air distributor, a steam drum in said convection heat exchange chamber, an array of tubes each connected at one end to said steam drum and passing through said reaction chamber and into and through said air distributor to connect with a header, said array of tubes having a vertical orientation in that portion of the reaction chamber occupied by said fluidized bed of particulate material, the walls of said housing in the region of said reaction chamber being water-cooled, said integral water-cooled floor and bridgewall assembly formed to provide said air distributor, one of said housing walls and said baffle, valve controlled conduit means within said housing and extending from said hopper portion of said baffle to a discharge port opening into said reaction chamber below the upper surface of said fluidized bed.

The fluidized bed heat exchanger of the invention may also be provided with a windbox region having at least two chambers each having an independent air supply and an associated group of tuyeres so that a selected part of said bed may be permitted to slump, or the whole of said bed of particulate material in said reaction chamber may be fluidized. If desired, the fluidized bed heat exchanger of the invention may also be provided with a plurality of jet nozzles in said housing in the region of said reactor chamber to direct a stream of air laterally at a slumped portion of the bed to prevent excessive accumulation of particulate material in said slumped bed.

Referring to the Figures, there is illustrated a fluidized bed heat exchanger 10 including a reactor vessel 11 having a roof 12, a front wall 13, a rear wall 14 and side walls 15. At the bottom of the reactor vessel 11 there is an air distributor 16 (a perforated refractory constriction plate) forming the bottom wall of the reactor vessel 11.

The air distributor 16 is supported on a plurality of horizontal beams 20. Windbox means 21 is positioned below the air distributor 16 and is provided with air inlet 22 and drain nozzles 24 and 25. Windbox means 21 comprises a main windbox chamber 30 and a secondary windbox chamber 31 which are independently operable (the air inlet for chamber 31 is not illustrated in the Figures). The air distributor 16 is perforated so that the windbox means 21 is in communication with the combustion chamber 17 and tuyeres 33 are positioned in bores which pierce the air distributor 16. Within the reactor vessel 11 there is provided a dust hopper 34 which serves with baffle portion 37 as a partial partition separating the combustion chamber 17 from a convection chamber 35. The interior walls of the reactor vessel 11 are of the so-called water-wall construction in which the walls 13, 14 and 15 incorporate a plurality of spaced, parallel tubes 28 joined to each other by a welded webbing 26 between adjacent tubes to form a gas-tight structure (See FIG. 2). The water wall elements may be covered by a layer of refractory 27 as in the front wall 13 or they may be unshielded as in the sidewalls 15.

It is a feature of this invention that an integral tube array 40 (See FIG. 4) is provided constructed from a plurality of specially formed tubes 39. The tubes 39, constituting the structural framework of the tube array 40, are joined in the lower portion thereof by a metal sheet or webbing 45 which is welded to the tubes. There are four distinct segments of the tube array 40: an upper sloped baffle segment 44 comprising spaced apart, straight, parallel lengths of tubes 39 forming a skeletal planar configuration; a hopper segment 42 joined to baffle segment 44 wherein the spaced apart tubes 39 are not in parallel alignment, but, instead, form a skeletal hopper segment 42; a wall segment 41 joined to the hopper segment 42 in which the tubes are parallel, have an essentially vertical orientation and are welded to a metal sheet or webbing 45, and an air distributor segment 43 joined to said wall segment 41 in which the tubes are in parallel alignment, are joined to each other by the sheet or webbing 45 and are oriented so as to incline slightly downwardly from the horizontal with increasing distance from the juncture with said vertical wall segment 41.

The tube array 40 can be formed, assembled and shipped as a unit to the construction site. Once positioned within the reactor, castable refractory may be placed on and about air distributor segment 43 to form the air distributor 16. Similarly, castable refractory is placed on and about the other segments of the water-wall element, especially the segments 42 and 44 to fill the spaces between tubes 39 to form integral baffle and hopper structures, and to cover the tubes as a shield against the severe environment within the reactor. Tube array 40 in assembled position within the reactor with refractory thereon constitutes the integral floor and bridgewall unit.

FIG. 4 shows the general configuration of the integral tube array 40 but it will be understood that secondary features of the unit, such as perforations in the air distributor segment and tube bends to accomodate feed inlets and a dust conduit are not shown to simplify the illustration.

In the convection chamber 35 there are provided a steam drum 47 and a mud drum 48. The steam drum 47 is provided with a steam outlet 50 and water from the steam drum 47 is circulated through the boiler bank 51 to the mud drum 48.

The header 52 is fed by water flowing down supply tubes 54 located in the walls of the reactor vessel. This water flows into the floor and bridgewall unit from the header 52. The water rises from header 52 through the air distributor 16, the water-cooled rear wall portion 14', the dust hopper 34 and finally baffle portion 37. In travelling through the floor and bridgewall unit, the water is vaporized to steam. The path of this water and steam through the floor and bridgewall unit can best be followed in FIG. 4 where the flow is seen to be upward in tubes 39, first through air distributor segment 43, then wall segment 41, hopper segment 42 and, lastly, baffle segment 44. As noted above, the tubes of the air distributor segment 43 slope upward from header 52 toward the rear wall segment 41. This slope prevents trapping of bubbles in the tubes of air distributor segment 43.

The header 53 receives water returned by supply tubes 54 within the refractory front wall 13 of the reactor vessel 11 and supplies that water to the front water-wall tubes 55, which are exposed to the heat of the combustion chamber, and is consequently turned to steam. The header 53 also supplies water to a plurality of in-bed steam tubes 60 which are vertically oriented in traversing the region in the combustion chamber 17 occupied by the fluidized bed. The tubes 60 pass upward from air distributor 16 through the reactor vessel 11 to join the steam drum 47.

An ash conduit 61 connects the lower end of hopper 34 with ash inlet 62, the latter located to introduce ash below the surface of the fluidized bed in the combustion chamber 17. A flapper valve 63 is positioned to control flow in the ash conduit 61. Feeedpipes 64 or other feed means are provided for introducing coal or limestone into the reactor vessel at inlets 64'. A plurality of jet nozzles 71 (FIG. 1) are provided through the reactor vessel wall at a predetermined slump bed level over the region receiving fluidizing air from the secondary windbox chamber 31. A cyclone return conduit 65 is provided for return of dust from an external cyclone (not shown). An inclined ash disposal conduit 72 is provided having access through the reactor vessel wall for removal of the contents of the fluidized bed. A start-up burner 73 is also provided.

In operation, a bed of inert particulate material (sand, for example) is supplied to the bed and is fluidized by supplying air to the main windbox 30. The start-up oil burner 73 is ignited and continues in operation until the ignition temperature of the coal is achieved in the fluidized bed. A quantity of coal is then introduced via feed pipes 64. Limestone may also be introduced into the bed through feedpipes 64 as required. When combustion of the coal is well established and self-sustaining, the operation of the start-up burner can be terminated. It should be noted that the secondary windbox chamber 31 has not been activated at this point in the operation of the reactor. The particulates thrown up by the fluidized bed above the main windbox chamber tend to accumulate upon the unfluidized slumped bed over the secondary windbox chamber 31. To prevent excessive accumulation of material in this region, which would inhibit later fluidization of the slumped bed, jet nozzles 71 are activated to direct streams of air upon accumulated material to force the excess quantity of particulates in the slumped bed region back into the fluidized bed region.

When it is desired to operate the fluidized bed heat exchanger at full capacity, the secondary windbox is activated to fluidize the slumped bed over that region. Rapid mixing of the particulates in the now fully fluidized bed takes place and the amounts of coal and limestone fed into the bed can be increased to take advantage of the combustion capacity of this larger fluidized bed combustion zone.

It will be seen that a substantial amount of steam is generated in the water-cooled walls of the combustion chamber. Particularly good heat transfer is achieved in the vertical bed tubes 60 which are in direct contact with the hot, fluidized bed particulates and gases. The vertical orientation of these tubes reduces to a minimum the effect of erosion by bed particles which is commonly suffered by horizontal in-bed tubes or in tube arrays having return bends within the fluidized bed.

The hot gases generated in the fluidized bed rise through the freeboard (the zone in the combustion chamber above the expanded bed) and are deflected by the baffle 37 before turning about the upper end of baffle 37 to pass through the convection chamber 35 and the boiler bank 51 therein to exit at last through the exhaust conduit 18. The combustion gases exiting combustion chamber 17 carry a substantial burden of dust. In traversing convection chamber 35 the larger particules of unburned fuel, ash and limestone drop out and are collected by the hopper 34. The particles slide down the inclined surfaces of baffle 37 and hopper 34 into the ash conduit 61 for recycle into the fluidized bed. The gases leaving reactor vessel 11 through exhaust gas conduit 18 will carry a substantially reduced burden of fine dust, but it may be desirable to provide a cyclone (not shown) external to vessel 11 to capture these fine solids and return them to the fluidized bed through cyclone return conduit 65. In any case, the load on external cyclones is greatly reduced by the provision made for dust removal within the reactor vessel.

It will be understood that the two-chamber windbox may be utilized to obtain two distinct levels of output from this fluidized bed heat exchanger, each such level having a range of output possibilities dependent upon the space rate employed and other factors. Where larger units are involved three or more windbox compartments may be provided to provide even more flexibility in operation.

The present invention has been described particularly in connection with a steam generator, but this is exemplary only, and the invention can be used in other applications consistent with the foregoing description.

There has thus been described a compact and flexible fluidized bed heat exchanger which can utilize both high and low grade fuels.

Although the present invention has been described in conjunction with preferred embodiments, it is to be understood that modifications and variations may be resorted to without departing from the spirit and scope of the invention, as those skilled in the art will readily understand. Such modification and variations are considered to be within the purview and scope of the invention and appended claim.

We claim:

1. A fluidized bed heat exchanger comprising a housing, a reaction chamber within the housing, means for introducing air into said reaction chamber including a windbox region below said reaction chamber and an air distributor therebetween, an integral water-cooled floor and bridgewall assembly in said housing, a convection heat exchange chamber above said reaction chamber within said housing and separated from said reaction chamber by a slanted baffle, said baffle defining a gas passageway between said reaction chamber and said convection heat exchange chamber and having a hopper portion whereby dust is collected and removed from gases passing through said convection heat exchange chamber, means for establishing a bed of particulate material containing fuel in said reaction chamber, said bed of particulate material being subject to fluidization by air passing into said reaction chamber from said windbox region through said air distributor, a steam drum in said convection heat exchange chamber, an array of tubes each connected at one end to said steam drum and passing through said reaction chamber and into and through said air distributor to connect with a header, said array of tubes having a vertical orientation in that portion of the reaction chamber occupied by said fluidized bed of particulate material, the walls of said housing in the region of said reaction chamber being water-cooled, said integral water-cooled floor and bridgewall assembly formed to provide said air distributor, one of said housing walls, and said baffle, valve controlled conduit means within said housing and extending from said hopper portion of said baffle to a discharge port opening into said reaction chamber below the upper surface of said fluidized bed.

2. The fluidized bed heat exchanger of claim 1 wherein the arrangement of water-carrying tubes is such as to provide natural circulation of the water.

3. The fluidized bed heat exchanger of claim 2 wherein said windbox region has at least two independent windbox chambers each associated with a separate group of tuyeres in said air distributor so that a selected portion of said bed of particulate material may be permitted to slump by not supplying air to one of said windbox chambers while the balance of said bed is fluidized by supply of air to the windbox chamber therebelow.

4. The fluidized bed heat exchanger of claim 3 wherein a plurality of jet nozzles are provided in said housing in the region of said reactor chamber to direct a stream of air laterally at a slumped portion of said bed to prevent excessive accumulation of particulate material on said slumped bed.

5. A fluidized bed heat exchanger comprising a housing, means for introducing fuel and air into said housing for combustion therein, said housing having therein a unitary floor and bridgewall assembly, said unitary floor and bridgewall assembly defining and separating within said housing a combustion chamber, a windbox region below said combustion chamber and a convection heat exchange chamber above said combustion chamber, said unitary floor and bridgewall assembly comprising a skeletal array of coolant tubes for circulation of a coolant therethrough to prevent overheating of said assembly, the surfaces of said assembly which are exposed in said combustion and convection chambers having a protective layer of refractory thereon, a floor portion of said unitary floor and bridgewall assembly having perforations therethrough constituting an air distributor for air traversing said perforations from said windbox to said combustion chamber, a baffle portion of said unitary floor and bridgewall assembly having a sloped orientation within said housing, and, at the upper end thereof, defining a gas port between the edge of said baffle portion and one wall of said housing to accommodate the gases flowing from said combustion chamber to said convection chamber, a wall portion of said unitary floor and bridgewall assembly forming one wall of said combustion chamber and joining said floor portion to said baffle portion so that cooling water may be circulated successively through the coolant tubes of said floor portion, said wall portion and said baffle portion, the upper section of said baffle portion forming a planar baffle and the lower section forming a v-shaped hopper so that dust dropped by the exhaust gas in said convection chamber slides down the planar baffle and is channeled by the hopper to a conduit for removal from said convection chamber and heat exchange means in said housing for extracting heat from the combustion gases generated therein.

6. The fluidized bed heat exchanger of claim 5 wherein all walls of said combustion chamber are water-cooled.

7. The fluidized bed heat exchanger of claim 6 wherein said heat exchange means includes a plurality of vertically disposed heat exchange tubes in said combustion chamber remote from said walls.

8. The fluidized bed heat exchanger of claim 7 wherein said heat exchange tubes in said combustion chamber are connected to a steam drum in said convection chamber.

9. The fluidized bed heat exchanger of claim 8 wherein said windbox region has at least two independent windbox chambers each associated with a separate group of tuyeres in said air distributor so that each group of tuyeres may be selectively utilized.

10. The fluidized bed heat exchanger of claim 9 wherein a plurality of jet nozzles are provided in said housing in the region of said reactor chamber to direct a stream of air laterally at a predetermined level above said air distributor.

* * * * *